US008587206B2

(12) United States Patent
Sun et al.

(10) Patent No.: US 8,587,206 B2
(45) Date of Patent: Nov. 19, 2013

(54) LED POWER SUPPLY DEVICE

(75) Inventors: Juanjuan Sun, Nanjing (CN); Shaobin Zhang, Nanjing (CN); Xiang Li, Nanjing (CN)

(73) Assignees: FSP Technology Inc., Taoyuan County (TW); FSP-Powerland Technology Inc., Nanjing (CN)

( * ) Notice: Subject to any disclaimer, the term of this patent is extended or adjusted under 35 U.S.C. 154(b) by 126 days.

(21) Appl. No.: 13/349,579

(22) Filed: Jan. 13, 2012

(65) Prior Publication Data

US 2012/0194089 A1 Aug. 2, 2012

(30) Foreign Application Priority Data

Jan. 28, 2011 (CN) ..... 2011 1 0030945

(51) Int. Cl.
*H05B 37/00* (2006.01)

(52) U.S. Cl.
USPC ..... 315/200 R; 315/307

(58) Field of Classification Search
None
See application file for complete search history.

(56) References Cited

U.S. PATENT DOCUMENTS

2011/0074314 A1* 3/2011 Cheng ..... 315/307

* cited by examiner

*Primary Examiner* — Crystal L Hammond
(74) *Attorney, Agent, or Firm* — Jianq Chyun IP Office

(57) ABSTRACT

An LED power supply device is provided. In the invention, a digital control device and a programmable interface are used to set an output specification of the LED power supply device, such that one smart LED power supply device can be used to supply power to the LED lamps of different specifications. In this way, it is unnecessary to specifically design and test the power supply devices for the LED lamps of different specifications, so that a design and production cycle of the LED power supply devices and costs thereof are greatly reduced. On the other hand, usage of the digital control device avails monitoring and controlling a state of the LED lamp, for example, implementing temperature control, time control, color and luminance control, etc., by which a service life, efficiency and flexibility of the LED lamp are enhanced.

34 Claims, 5 Drawing Sheets

LED POWER SUPPLY DEVICE

CROSS-REFERENCE TO RELATED APPLICATION

This application claims the priority benefit of China application serial no. 201110030945.4, filed on Jan. 28, 2011. The entirety of the above-mentioned patent application is hereby incorporated by reference herein and made a part of this specification.

BACKGROUND OF THE INVENTION

1. Field of the Invention

The invention relates to a light emitting diode (LED) power supply device. Particularly, the invention relates to a smart LED power supply device controlled by a digital control device, which is capable of setting an output specification through programming.

2. Description of Related Art

Application of light emitting diode (LED) lamp is very wide, and a power supply device of the LED lamp has two implementations, where a first type constant current power supplying method is at that shown in FIG. 1, in which an input terminal of a power supply device 102 is connected to L and N poles of an alternating current (AC) power 101, and an output terminal thereof is coupled to An LED lamp 109. The power supply device 102 of the LED lamp 109 includes a constant voltage power supply system 104 and a constant current power supply system 107. The front-end constant voltage power supply system 104 includes a constant voltage power supply device 103 and a corresponding analog control device 105, and the back-end constant current power supply system 107 includes a constant current power supply device 108 and a corresponding analog control device 106, where an output terminal of the constant current power supply system 107 is connected to the LED lamp 109 for providing the required specific direct current (DC) current and voltage to the LED lamp 109. The constant current power supply system 107 and the LED lamp 109 are separated from each other.

A second type constant voltage power supplying method of the LED lamp is at that shown in FIG. 2, and an input terminal of the constant voltage power supply system 104 is connected to the L and N poles of the AC power 101, and an output terminal thereof is connected to the constant current power supply system 107. The constant voltage power supply system 104 includes the constant voltage power supply device 103 and the corresponding analog control device 105, and the constant current power supply system 107 includes the constant current power supply device 108 and the corresponding analog control device 106, where an output terminal of the constant current power supply system 107 is connected to the LED lamp 109 for providing the required specific DC current and voltage to the LED lamp 109. The constant current power supply system 107 and the LED lamp 109 are altogether installed inside a casing of the LED lamp 109 to form an integral device.

Both of the constant current and constant voltage LED power supply devices of the conventional technique have following shortages. The power supply devices have to be specifically designed and tested in allusion to different demands of input current and voltage of different LED lamps. Meanwhile, the existing LED lamps have a wide range of requirement for the input current and voltage, so that a production cycle of the existing LED power supply devices is relatively long, and cost thereof is relatively high.

SUMMARY OF THE INVENTION

The invention is directed to a light-emitting diode (LED) power supply device for resolving a defect of a conventional technique.

The invention provides an LED power supply device including an AC power and a power supply device, where the power supply device includes a front-end constant voltage power supply system and a back-end constant current power supply system. The front-end constant voltage power supply system includes a constant voltage power supply device, and the back-end constant current power supply system includes a constant current power supply device. An input terminal of the constant voltage power supply device is connected to an L pole and an N pole of the AC power, an output terminal of the constant voltage power supply device is connected to an input terminal of the constant current power supply device, and an output terminal of the constant current power supply device is connected to an LED lamp. The power supply device further includes a programmable interface, an analog control device corresponding to the constant voltage power supply device is disposed in the front-end constant voltage power supply system, and a digital control device corresponding to the constant current power supply device is disposed in the back-end constant current power supply system, where the digital control device communicates with an upper computer through the programmable interface, and the digital control device also communicates with the LED lamp.

The invention provides an LED power supply device including an AC power and a power supply device, where the power supply device includes a two-stage power supply system. The two-stage power supply system includes a front-end constant voltage power supply system and a back-end constant current power supply system. The front-end constant voltage power supply system includes a constant voltage power supply device, and the back-end constant current power supply system includes a constant current power supply device. An input terminal of the constant voltage power supply device is connected to an L pole and an N pole of the AC power, an output terminal of the constant voltage power supply device is connected to an input terminal of the constant current power supply device, and an output terminal of the constant current power supply device is connected to an LED lamp. The power supply device further includes a programmable interface, and a digital control device corresponding to the constant voltage power supply device and the constant current power supply device is disposed in the two-stage power supply system, where the digital control device communicates with an upper computer through the programmable interface, and the digital control device also communicates with the LED lamp.

The invention provides an LED power supply device including an AC power, a front-end constant voltage power supply system, a back-end constant current power supply system and a programmable interface. The front-end constant voltage power supply system includes a constant voltage power supply device, and the back-end constant current power supply system includes a constant current power supply device. The back-end constant current power supply system and an LED lamp form an integral device. An input terminal of the constant voltage power supply device is connected to an L pole and an N pole of the AC power, an output terminal of the constant voltage power supply device is connected to an input terminal of the constant current power supply device, and an output terminal of the constant current power supply device is connected to the LED lamp. A digital control device corresponding to the constant voltage power supply device is disposed in the front-end constant voltage power supply system, and an analog control device corresponding to the constant current power supply device is disposed in the back-end constant current power supply system, where the digital control device communicates with an upper computer through the programmable interface.

In one embodiment of the invention, the upper computer can set the digital control device through the programmable interface, so as to make the LED power supply device to supply power to the LED lamp of different specifications.

In one embodiment of the invention, the digital control device may perform a plurality of functions relating to the LED lamp due to the communication between the digital control device and the LED lamp, where the functions may include a state monitoring, a temperature control, a time control, a color and luminance control for the LED lamp.

In the invention, the digital control device and the programmable interface are used to set an output specification of the LED power supply device, such that one smart LED power supply device can be used to supply power to the LED lamps of different specifications. In this way, it is unnecessary to specifically design and test the power supply devices for the LED lamps of different specifications, so that a design and production cycle of the LED power supply devices and costs thereof are greatly reduced. On the other hand, usage of the digital control device avails monitoring and controlling a state of the LED lamp, for example, implementing temperature control, time control, color and luminance control, etc., by which a service life, efficiency and flexibility of the LED lamp are enhanced.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
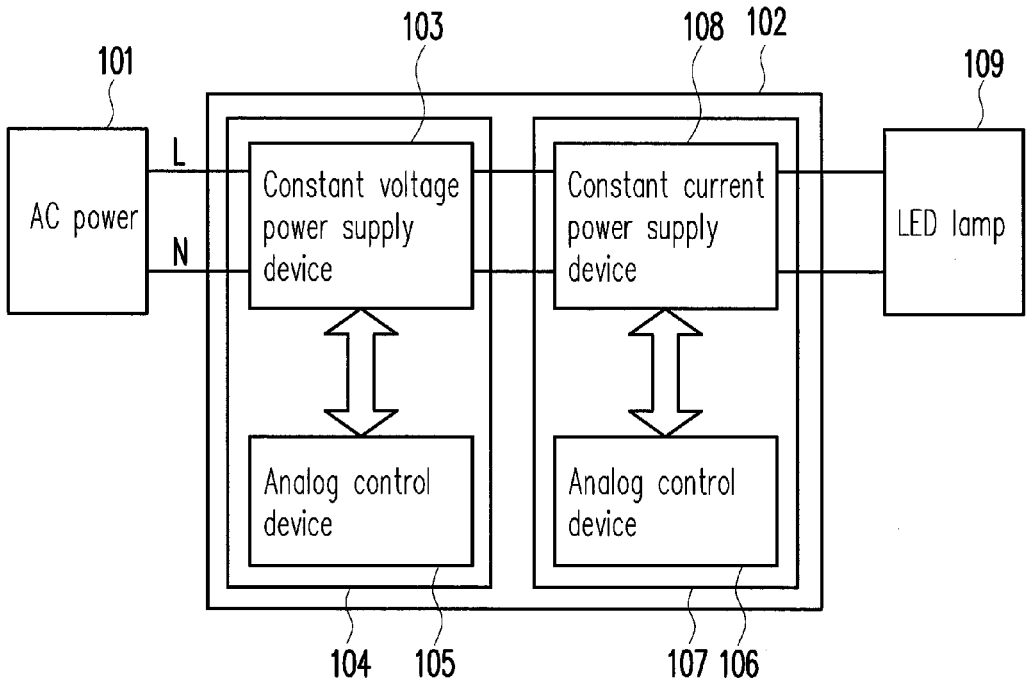
FIG. 1 is a structural diagram of an existing constant current LED power supply device.

The exemplary embodiments of the disclosure are illustrated in detail below with reference to the accompanying drawings. In addition, components/members of the same reference numerals are used to represent the same or similar parts in the accompanying drawings and implementations wherever it is possible.

Figure 2:
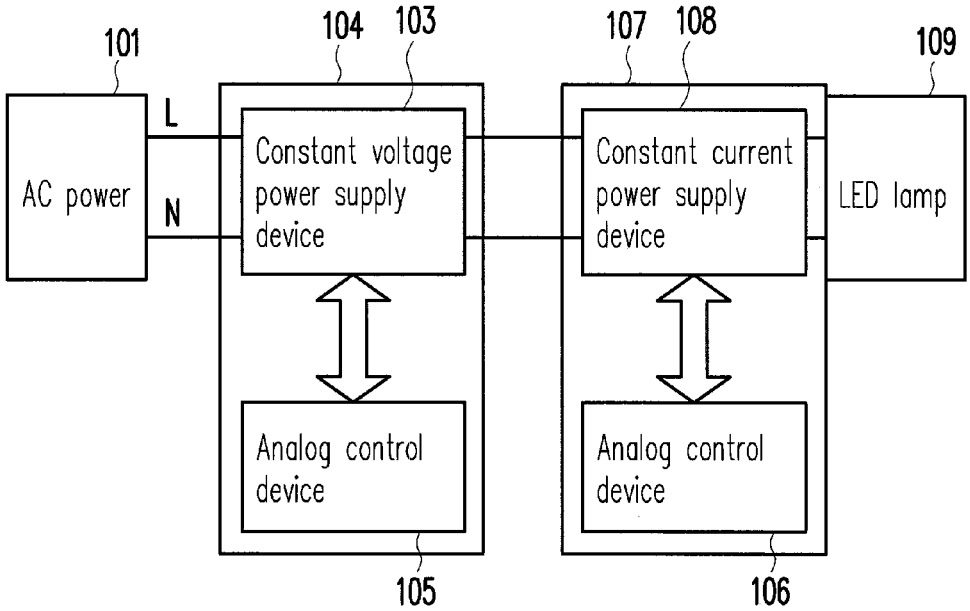
FIG. 2 is a structural diagram of an existing constant voltage LED power supply device.

It should be noted firstly that the invention provides a smart LED power supply device controlled by a digital control device, which is capable of setting an output specification through programming. Compared to the two different types of LED power supply device of the related art, the smart LED power supply device of the invention has three implementations. Regarding the constant current LED power supplying method shown in FIG. 1, the smart LED power supply device has two implementations as that shown in FIG. 3 and FIG. 4, and regarding the constant voltage LED power supplying method shown in FIG. 2, the smart LED power supply device has one implementation as that shown in FIG. 5.

Figure 3:
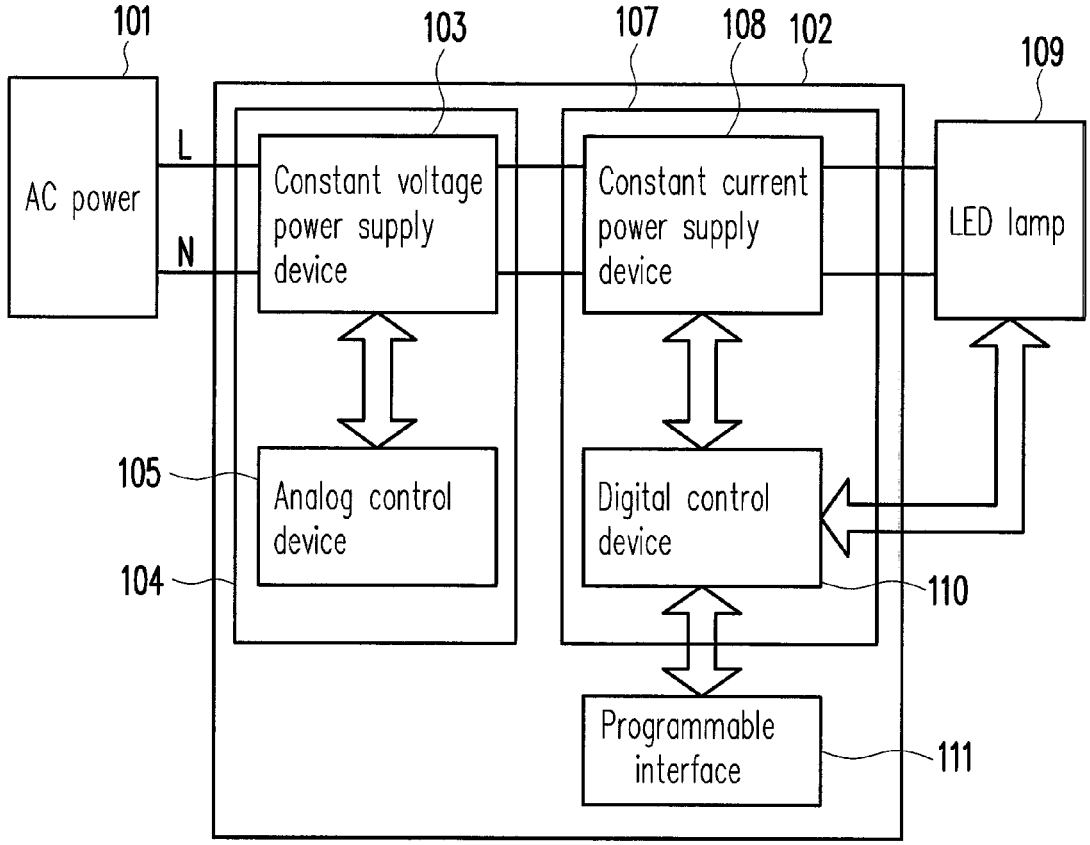
FIG. 3 is a structural diagram of a constant current LED power supply device according to an embodiment of the invention.

As shown in FIG. 3, an input terminal of a power supply device 102 is connected to an L pole and an N pole of an alternating current (AC) power 101, and an output terminal thereof is connected to an LED lamp 109. The power supply device 102 includes a constant voltage power supply system 104, a constant current power supply system 107 and a programmable interface 111. The front-end constant voltage power supply system 104 includes a constant voltage power supply device 103 and an analog control device 105, and the back-end constant current power supply system 107 includes a constant current power supply device 108 and a digital control device 110. An output terminal of the constant current power supply system 107 is connected to the LED lamp 109 for providing required specific DC current and voltage to the LED lamp 109. The digital control device 110 is implemented by a digital control chip to perform digital communication with the constant current power supply device 108, so as to control an output current and an output voltage of the constant current power supply device 108. Meanwhile, the digital control device 110 also performs digital communication with the LED lamp 109 in order to achieve functions such as state monitoring, temperature control, time control, color and luminance control, etc. of the LED lamp 109. The programmable interface 111 is connected to the digital control device 110 through digital communication, so as to implement functions of setting the output current, the output voltage and a protection point of the constant current power supply device 108. Therefore, the power supply device 102 as shown in FIG. 3 can implement functions of setting the output current, the output voltage and the protection point thereof through programming, so as to achieve a purpose of using one power supply device 102 to supply power to the LED lamp 109 of different specifications.

Figure 4:
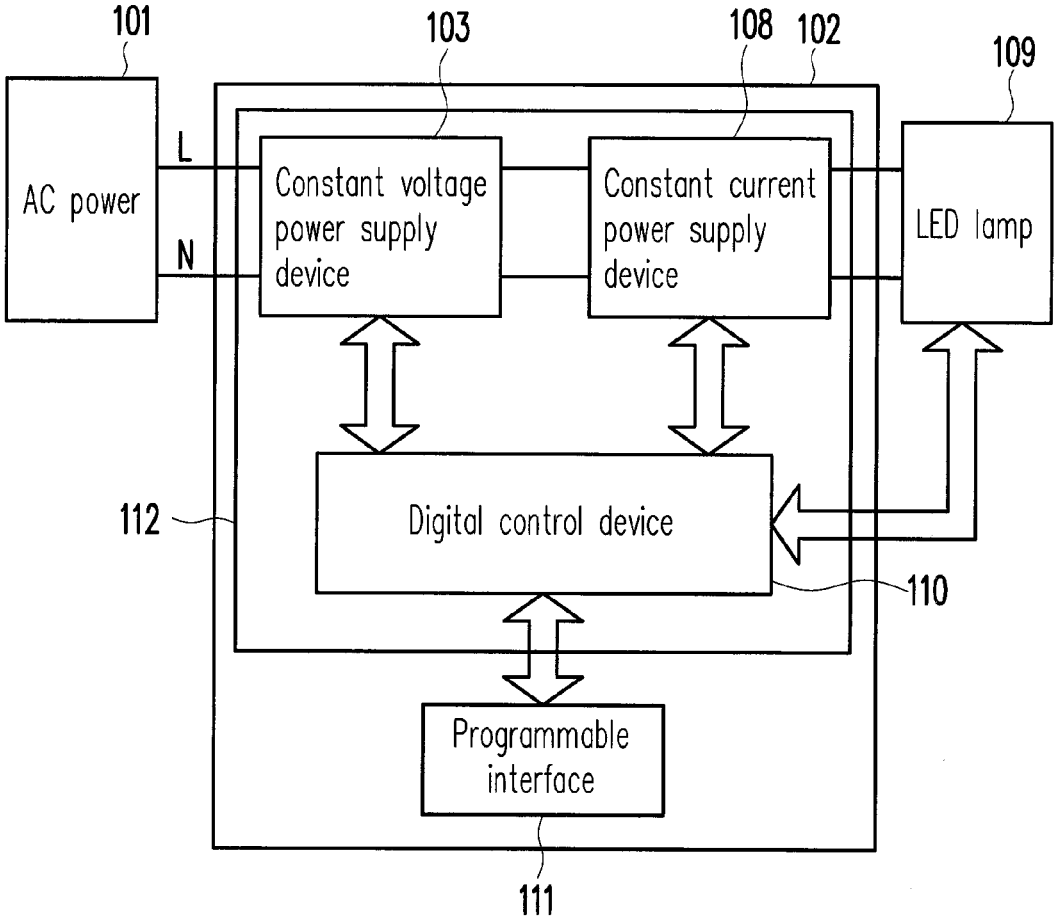
FIG. 4 is a structural diagram of another constant current LED power supply device according to an embodiment of the invention.

As shown in FIG. 4, the input terminal of the power supply device 102 is connected to the L pole and the N pole of the AC power 101, and the output terminal thereof is connected to the LED lamp 109. The power supply device 102 includes a two-stage power supply system 112 and the programmable interface 111. The two-stage power supply system 112 includes the front-end constant voltage power supply device 103, the back-end constant current power supply device 108 and the digital control device 110. The output terminal of the constant current power supply device 108 is connected to the LED lamp 109 for providing the required specific DC current and voltage to the LED lamp 109. The digital control device 110 is implemented by a digital control chip to perform digital communication with the constant voltage power supply device 103 and the constant current power supply device 108, so as to control output currents and output voltages thereof. Meanwhile, the digital control device 110 also performs digital communication with the LED lamp 109 in order to achieve functions such as state monitoring, temperature control, time control, color and luminance control, etc. of the LED lamp 109. The programmable interface 111 is connected to the digital control device 110 through digital communication, so as to implement functions of setting the output currents, the output voltages and protection points of the constant voltage power supply device 103 and the constant current power supply device 108. Therefore, the power supply device 102 as shown in FIG. 4 can implement functions of setting the output current, the output voltage and the protection point thereof through programming, so as to achieve a purpose of using one power supply device 102 to supply power to the LED lamp 109 of different specifications.

Figure 5:
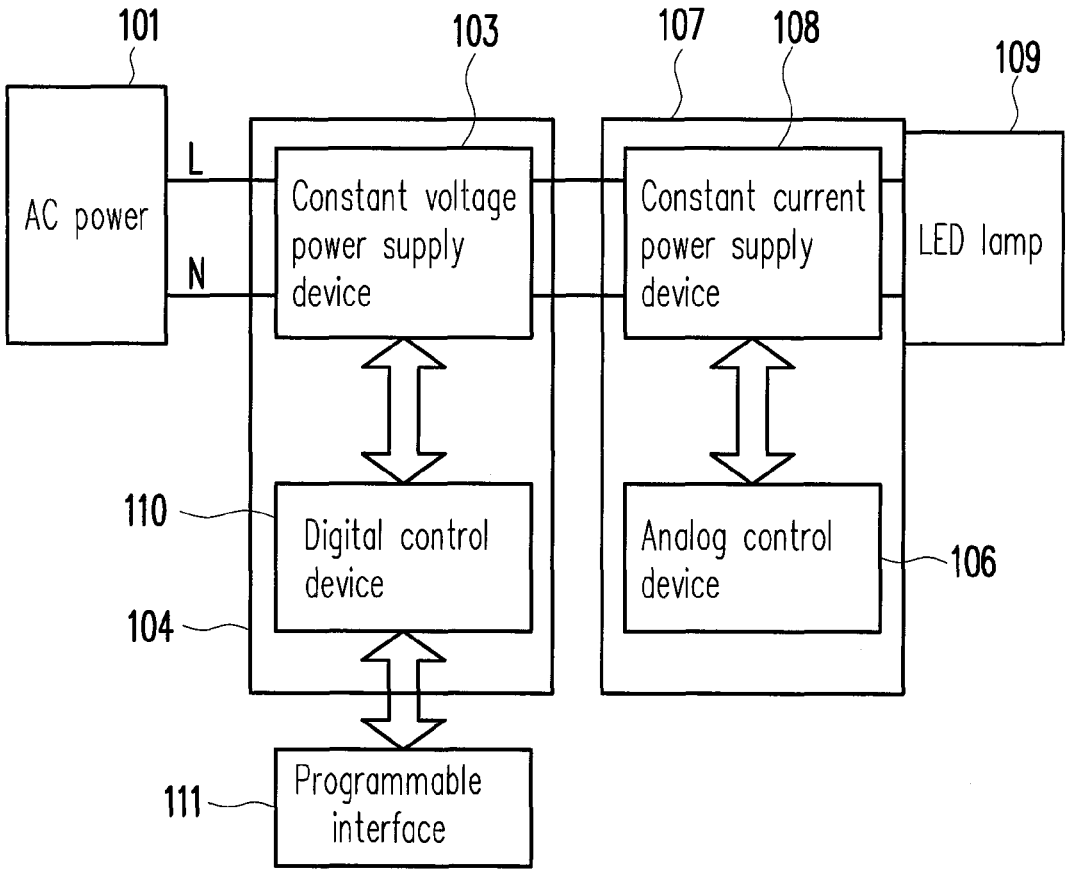
FIG. 5 is a structural diagram of a constant voltage LED power supply device according to an embodiment of the invention.
Figure 6:
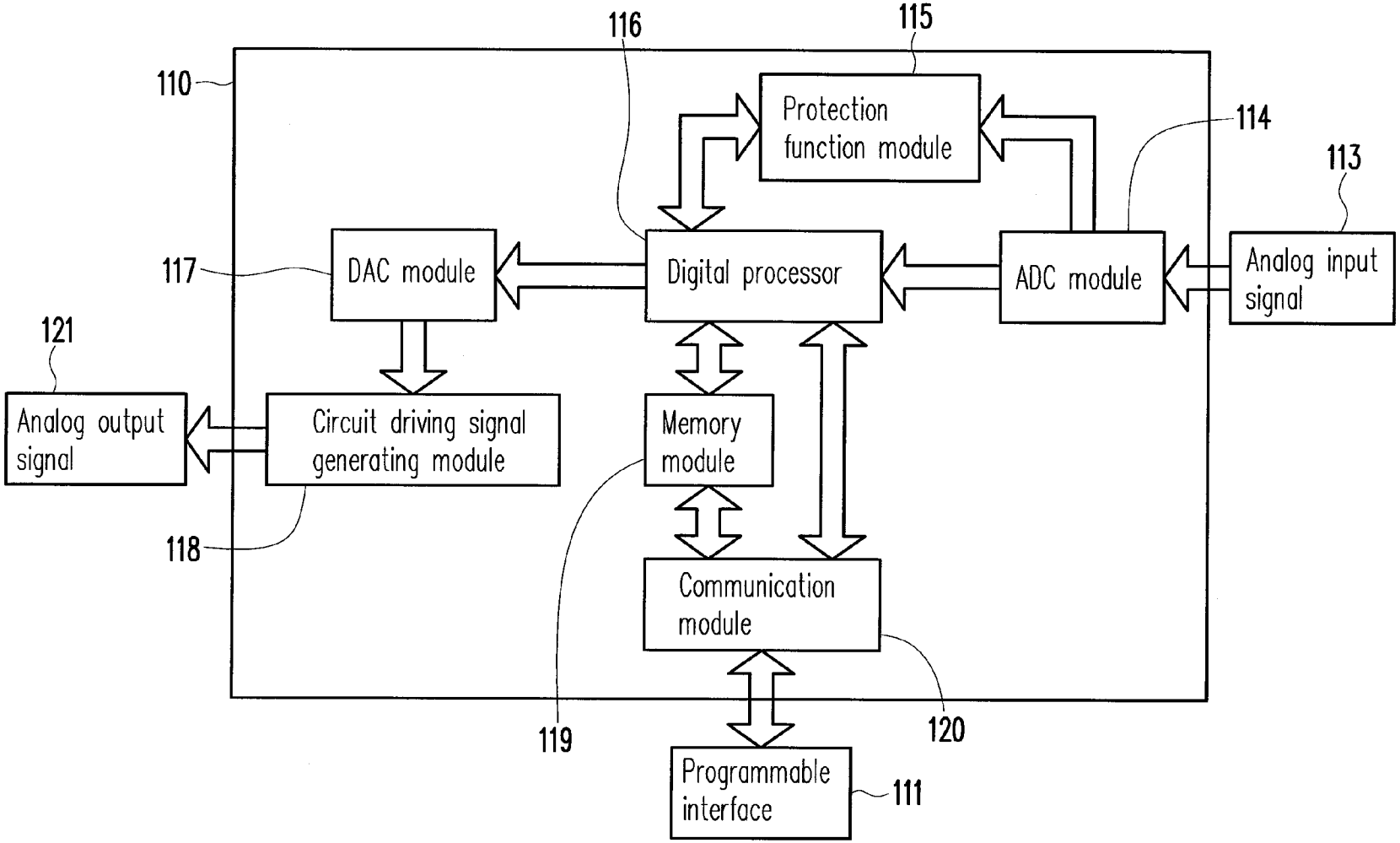
FIG. 6 is a structural diagram of a digital control device according to an embodiment of the invention.

In FIG. 5, the input terminal of the constant voltage power supply system 104 is connected to the L pole and the N pole of the AC power 101, and the output terminal thereof is connected to the constant current power supply system 107. The constant voltage power supply system 104 includes the constant voltage power supply device 103 and the digital control device 110, where the digital control device 110 is implemented by a digital control chip to perform digital communication with the constant voltage power supply device 103, so as to control the output voltage and the output current thereof. Meanwhile, the programmable interface 111 is connected to the digital control device 110 through digital communication, so as to implement functions of setting the output voltage, the output current, the protection point and an operation time, etc. of the constant voltage power supply system 104. The constant current power supply system 107 includes the constant current power supply device 108 and the corresponding analog control device 106, and the output terminal thereof is connected to the LED lamp 109 for providing the required specific DC current and voltage to the LED lamp 109. The constant current power supply system 107 and the LED lamp 109 are altogether installed inside a casing of the LED lamp 109 to form an integral device. Therefore, the constant voltage power supply system 104 as shown in FIG. 5 can implement functions of setting the output current, the output voltage, the protection point and the operation time thereof through programming, so as to achieve a purpose of supplying power to the LED lamp 109 of different specifications.

In the embodiments of FIG. 3, FIG. 4 and FIG. 5, the power supply device 102 and the constant voltage power supply system 104 may have multiple outputs such as triple output, or may have other numbers of outputs.

Regarding the digital control device 110 of FIG. 3, FIG. 4 and FIG. 5, FIG. 6 illustrates an internal structure thereof. The digital control device 110 includes an analog-to-digital converter (ADC) module 114, a protection function module 115, a digital processor 116, a digital-to-analog converter (DAC) module 117, a circuit driving signal generating module 118, a memory module 119 and a communication module 120. The ADC module 114 receives an analog input signal 113 from external, and converts it into a digital signal for outputting to the digital processor 116. The analog input signal 113 can be a voltage signal, a current signal or a temperature signal collected from the constant voltage power supply device 103, the constant current power supply device 108 and the LED lamp 109, though the invention is not limited thereto. In other words, the analog input signal 113 can also be a detected light intensity or a detected ambient light of the LED lamp 109. The ADC module 114 also provides an input signal to the protection function module 115. The digital processor 116 receives digital input signals from the protection function module 115, the ADC module 114, the memory module 119 and the communication module 120, and synthetically processes the digital input signals for providing input signals to the protection function module 115, the DAC module 117, the memory module 119 and the communication module 120. The protection function module 115 protects the whole LED power supply device according to the input signals of the ADC module 114 and the digital processor 116. The DAC module 117 receives a digital input signal from the digital processor 116, and converts it into an analog output signal. The circuit driving signal generating module 118 receives the analog output signal, and converts it into an analog output signal 121 that can be recognized by the constant voltage power supply device 103, the constant current power supply device 108 and the LED lamp 109. The analog output signal 121 can be used to control output specifications or operation modes, time or power, etc. of the constant voltage power supply device 103, the constant current power supply device 108 and the LED lamp 109. The digital processor 116 and the communication module 120 are connected to each other, and the communication module 120 can be connected to an upper computer through the programmable interface 111, moreover, the upper computer may communicate with the programmable interface 111 in a wire or wireless manner, such that the functions and parameters of the digital processor 116 can be set through the communication between the upper computer and the communication module 120, so as to achieve the purpose of using one smart LED power supply device to supply power to the LED lamp of different specifications. Based on the communication of the upper computer and the communication module 120, state parameters of the digital processor 116 can be read and controlled, so as to achieve a purpose of learning operating states of the smart LED power supply device and the connected LED lamp in real-time. The communication between the digital processor 116 and the communication module 120 can also be performed through the memory module 119, and meanwhile the memory module 119 can store parameters such as the output current, the output voltage, and the protection point, etc. of the smart LED power supply device of the invention, or record input output states in case of error, predetermined operation modes or operation time, etc., but not limited thereto. In other words, the stored parameters may also include the temperature, the brightness, many other different output currents, many other different output voltages, and many other different protection points based on many other different output/dimming applications or many other different user selected operation modes. In this way, practicality, reliability and flexibility of the smart LED power supply device of the invention are improved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A light-emitting diode (LED) power supply device, comprising:

an alternating current (AC) power; and a power supply device, comprising:

a front-end constant voltage power supply system comprising:

a constant voltage power supply device, having an input terminal connected to an L pole and an N pole of the AC power; and an analog control device, corresponding to the constant voltage power supply device, and disposed in the front-end constant voltage power supply system;

a back-end constant current power supply system comprising:

a constant current power supply device, having an input terminal connected to an output terminal of the constant voltage power supply device and an output terminal connected to an LED lamp; and a digital control device, corresponding to the constant current power supply device, and disposed in the back-end constant current power supply system; and a programmable interface, wherein the digital control device communicates with an upper computer through the programmable interface, wherein the upper computer sets the digital control device through the programmable interface, so as to make the LED power supply device to supply power to the LED lamp of different specifications.

2. The LED power supply device as claimed in claim 1, wherein the digital control device is configured for receiving and processing an analog input signal relating to the constant current power supply device and the LED lamp, so as to control the constant current power supply device and the LED lamp.

3. The LED power supply device as claimed in claim 2, wherein the upper computer further sets the digital control device through the programmable interface, so as to at least control an output and operation modes for the LED power supply device.

4. The LED power supply device as claimed in claim 1, wherein the digital control device comprises:

an analog-to-digital converter (ADC) module;

a protection function module;

a digital processor;

a digital-to-analog converter (DAC) module;

a circuit driving signal generating module;

a memory module; and a communication module, wherein an output terminal of the ADC module is coupled to input terminals of the protection function module and the digital processor;

the digital processor is two-way communicated with the protection function module, the memory module and the communication module;

an output terminal of the digital processor is connected in series to the DAC module and then connected to an input terminal of the circuit driving signal generating module; and the memory module is two-way communicated with the communication module.

5. The LED power supply device as claimed in claim 4, wherein the upper computer transmits parameters to the digital control device for processing through the programmable interface, such that the digital control device accordingly controls the constant current power supply device.

6. The LED power supply device as claimed in claim 4, wherein functions and parameters of the digital processor are set through a communication between the upper computer and the communication module, so as to make the LED power supply device to supply power to the LED lamp of different specifications.

7. The LED power supply device as claimed in claim 4, wherein a communication between the digital processor and the communication module is performed through the memory module.

8. The LED power supply device as claimed in claim 7, wherein the memory module stores a plurality of parameters relating to the LED power supply device, and the parameters at least comprise an output current, an output voltage and a protection point for the LED power supply device.

9. The LED power supply device as claimed in claim 7, wherein the memory module further records input output states in case of error, predetermined operation modes or operation time for the LED power supply device.

10. The LED power supply device as claimed in claim 1, wherein the digital control device further communicates with the LED lamp, so as to perform a plurality of functions relating to the LED lamp.

11. The LED power supply device as claimed in claim 10, wherein the functions at least comprise a state monitoring, a temperature control, a time control, a color and luminance control.

12. The LED power supply device as claimed in claim 1, wherein the upper computer communicates with the programmable interface by a wire or wireless manner.

13. A light-emitting diode (LED) power supply device, comprising:

an AC power; and a power supply device, comprising:

a two-stage power supply system, comprising:

a front-end constant voltage power supply device, having an input terminal connected to an L pole and an N pole of the AC power;

a back-end constant current power supply device, having an input terminal connected to an output terminal of the constant voltage power supply device and an output terminal connected to an LED lamp; and a digital control device, corresponding to both the constant voltage power supply device and the constant current power supply device, and disposed in the two-stage power supply system; and a programmable interface, wherein the digital control device communicates with an upper computer through the programmable interface, wherein the upper computer sets the digital control device through the programmable interface, so as to make the LED power supply device to supply power to the LED lamp of different specifications.

14. The LED power supply device as claimed in claim 13, wherein the digital control device is configured for receiving and processing an analog input signal relating to the front-end constant voltage power supply device, the back-end constant current power supply device and the LED lamp, so as to control the front-end constant voltage power supply device, the back-end constant current power supply device and the LED lamp.

15. The LED power supply device as claimed in claim 14, wherein the upper computer further sets the digital control device through the programmable interface, so as to at least control an output and operation modes for the LED power supply device.

16. The LED power supply device as claimed in claim 13, wherein the digital control device comprises:

an analog-to-digital converter (ADC) module;

a protection function module;

a digital processor;

a digital-to-analog converter (DAC) module;

a circuit driving signal generating module;

a memory module; and a communication module, wherein an output terminal of the ADC module is coupled to input terminals of the protection function module and the digital processor;

the digital processor is two-way communicated with the protection function module, the memory module and the communication module;

an output terminal of the digital processor is connected in series to the DAC module and then connected to an input terminal of the circuit driving signal generating module; and the memory module is two-way communicated with the communication module.

17. The LED power supply device as claimed in claim 16, wherein the upper computer transmits parameters to the digital control device for processing through the programmable interface, such that the digital control device accordingly controls the front-end constant voltage power supply device and/or the constant current power supply device.

18. The LED power supply device as claimed in claim 16, wherein functions and parameters of the digital processor are set through a communication between the upper computer and the communication module, so as to make the LED power supply device to supply power to the LED lamp of different specifications.

19. The LED power supply device as claimed in claim 16, wherein a communication between the digital processor and the communication module is performed through the memory module.

20. The LED power supply device as claimed in claim 19, wherein the memory module stores a plurality of parameters relating to the LED power supply device, and the parameters at least comprise an output current, an output voltage and a protection point for the LED power supply device.

21. The LED power supply device as claimed in claim 19, wherein the memory module further records input output states in case of error, predetermined operation modes or operation time for the LED power supply device.

22. The LED power supply device as claimed in claim 13, wherein the digital control device further communicates with the LED lamp, so as to perform a plurality of functions relating to the LED lamp.

23. The LED power supply device as claimed in claim 22, wherein the functions at least comprise a state monitoring, a temperature control, a time control, a color and luminance control.

24. The LED power supply device as claimed in claim 13, wherein the upper computer communicates with the programmable interface by a wire or wireless manner.

25. A light emitting diode (LED) power supply device, comprising:

an AC power;

a front-end constant voltage power supply system, comprising:

a constant voltage power supply device, having an input terminal connected to an L pole and an N pole of the AC power; and a digital control device, corresponding to the constant voltage power supply device, and disposed in the front-end constant voltage power supply system;

a back-end constant current power supply system, comprising:

a constant current power supply device, having an input terminal connected to an output terminal of the constant voltage power supply device and an output terminal connected to an LED lamp, wherein the back-end constant current power supply system and the LED lamp form an integral device; and an analog control device, corresponding to the constant current power supply device, and disposed in the back-end constant current power supply system; and a programmable interface, wherein the digital control device communicates with an upper computer through the programmable interface, wherein the upper computer sets the digital control device through the programmable interface, so as to make the LED power supply device to supply power to the LED lamp of different specifications.

26. The LED power supply device as claimed in claim 25, wherein the digital control device is configured for receiving and processing an analog input signal relating to the constant voltage power supply device, so as to control the constant voltage power supply device.

27. The LED power supply device as claimed in claim 26, wherein the upper computer further sets the digital control device through the programmable interface, so as to at least control an output and operation modes for the LED power supply device.

28. The LED power supply device as claimed in claim 25, wherein the digital control device comprises:

an analog-to-digital converter (ADC) module;

a protection function module;

a digital processor;

a digital-to-analog converter (DAC) module;

a circuit driving signal generating module;

a memory module; and a communication module, wherein an output terminal of the ADC module is coupled to input terminals of the protection function module and the digital processor;

the digital processor is two-way communicated with the protection function module, the memory module and the communication module;

an output terminal of the digital processor is connected in series to the DAC module and then connected to an input terminal of the circuit driving signal generating module; and the memory module is two-way communicated with the communication module.

29. The LED power supply device as claimed in claim 28, wherein the upper computer transmits parameters to the digital control device for processing through the programmable interface, such that the digital control device accordingly controls the constant voltage power supply device.

30. The LED power supply device as claimed in claim 28, wherein functions and parameters of the digital processor are set through a communication between the upper computer and the communication module, so as to make the LED power supply device to supply power to the LED lamp of different specifications.

31. The LED power supply device as claimed in claim 28, wherein a communication between the digital processor and the communication module is performed through the memory module.

32. The LED power supply device as claimed in claim 31, wherein the memory module stores a plurality of parameters relating to the LED power supply device, and the parameters at least comprise an output current, an output voltage and a protection point for the LED power supply device.

33. The LED power supply device as claimed in claim 31, wherein the memory module further records input output states in case of error, predetermined operation modes or operation time for the LED power supply device.

34. The LED power supply device as claimed in claim 25, wherein the upper computer communicates with the programmable interface by a wire or wireless manner.

* * * * *